US009303659B2

(12) United States Patent
Shin

(10) Patent No.: US 9,303,659 B2
(45) Date of Patent: Apr. 5, 2016

(54) METHOD OF CONTROLLING THE FLOW RATE OF A VARIABLE CAPACITY HYDRAULIC PUMP FOR A CONSTRUCTION APPARATUS

(75) Inventor: Hung-Ju Shin, Changwon-si (KR)

(73) Assignee: VOLVO CONSTRUCTION EQUIPMENT AB (SE)

( * ) Notice: Subject to any disclaimer, the term of this patent is extended or adjusted under 35 U.S.C. 154(b) by 312 days.

(21) Appl. No.: 13/994,857

(22) PCT Filed: Dec. 28, 2010

(86) PCT No.: PCT/KR2010/009404

§ 371 (c)(1),
(2), (4) Date: Jun. 17, 2013

(87) PCT Pub. No.: WO2012/091192

PCT Pub. Date: Jul. 5, 2012

(65) Prior Publication Data

US 2013/0263583 A1 Oct. 10, 2013

(51) Int. Cl.

| | |
|---|---|
| ***E02F 9/22*** | (2006.01) |
| ***F15B 9/04*** | (2006.01) |
| ***F15B 11/042*** | (2006.01) |

(52) U.S. Cl.

CPC ..... *F15B 9/04* (2013.01); *E02F 9/2235* (2013.01); *E02F 9/2285* (2013.01);
(Continued)

(58) Field of Classification Search

CPC ..... E02F 9/2235; E02F 9/2285; E02F 9/2296; F16H 61/431; F15B 9/04; F15B 11/0423
See application file for complete search history.

(56) References Cited

U.S. PATENT DOCUMENTS

| | | | |
|---|---|---|---|
| 6,209,321 | B1 | 4/2001 | Ikari |
| 6,823,672 | B2 | 11/2004 | Nakamura |

(Continued)

FOREIGN PATENT DOCUMENTS

| | | |
|---|---|---|
| JP | 06-221301 | 8/1994 |
| JP | 11-082414 A | 3/1999 |

(Continued)

OTHER PUBLICATIONS

Office Action dated Sep. 30, 2014 in corresponding JP2013-547277.

(Continued)

*Primary Examiner* — Nathaniel Wiehe
*Assistant Examiner* — Abiy Teka
(74) *Attorney, Agent, or Firm* — Harness, Dickey & Pierce, P.L.C.

(57) ABSTRACT

Disclosed is a method of controlling the flow rate of a hydraulic pump, which controls the discharge flow rate in proportion to a manipulated amount of a manipulation lever operated by a user even when the discharge pressure of the hydraulic pump is varied. The method of controlling the flow rate of a variable capacity hydraulic pump for a construction apparatus according to the present invention includes: a first step of calculating the required flow rate of the variable capacity hydraulic pump according to a manipulated amount of a manipulation lever operated by a user; a second step of calculating the maximum discharge flow rate within a range equal to or less than a preset horsepower or torque of the variable capacity hydraulic pump corresponding to the pressure detected by a discharge pressure detecting sensor; and a third step of controlling the discharge flow rate of the variable capacity hydraulic pump in proportion to a manipulated amount of the manipulation lever within a range equal to or less than the maximum discharge flow rate set in the second step.

3 Claims, 4 Drawing Sheets

(52) U.S. Cl.
CPC ..... *E02F 9/2296* (2013.01); *F15B 11/0423* (2013.01); *F15B 2211/20546* (2013.01); *F15B 2211/255* (2013.01); *F15B 2211/6309* (2013.01); *F15B 2211/6346* (2013.01); *F15B 2211/6652* (2013.01); *F15B 2211/6654* (2013.01); *F15B 2211/6655* (2013.01)

(56) References Cited

U.S. PATENT DOCUMENTS

| | | | | |
|---|---|---|---|---|
| 6,826,457 | B2 | 11/2004 | Henson et al. | |
| 2003/0019681 | A1 | 1/2003 | Nakamura | |
| 2006/0004507 | A1* | 1/2006 | Teslak et al. | 701/69 |
| 2009/0293468 | A1* | 12/2009 | Kim | 60/327 |
| 2010/0106382 | A1 | 4/2010 | Kodaka et al. | |
| 2013/0098021 | A1 | 4/2013 | Shin et al. | |
| 2013/0103270 | A1 | 4/2013 | Joung et al. | |
| 2013/0121852 | A1 | 5/2013 | Joung et al. | |

FOREIGN PATENT DOCUMENTS

| | | | |
|---|---|---|---|
| JP | 2001-193702 | A | 7/2001 |
| JP | 2002-188177 | A | 7/2002 |
| JP | 2008-215084 | A | 9/2008 |
| KR | 10-1994-0026402 | A | 12/1994 |

OTHER PUBLICATIONS

International Search Report (in Korean and English) and Written Opinion (in Korean) for PCT/KR2010/009404, mailed Sep. 1, 2011; ISA/KR.

International Preliminary Report on Patentability (Chapter II) (in Korean) for PCT/KR2010/009404, dated Mar. 28, 2013; IPEA/KR.

* cited by examiner

METHOD OF CONTROLLING THE FLOW RATE OF A VARIABLE CAPACITY HYDRAULIC PUMP FOR A CONSTRUCTION APPARATUS

FIELD OF THE INVENTION

The present invention relates to a method of controlling a flow rate of a variable displacement hydraulic pump for a construction machine, in which a discharge flow rate of a hydraulic pump is controlled according to the manipulation amount of a manipulation lever (RCV) by a user. More particularly, the present invention relates to such a flow rate control method of a hydraulic pump, in which a discharge flow rate of the hydraulic pump can be controlled in proportional to the manipulation amount of a manipulation lever even when the discharge pressure of the hydraulic pump is changed.

BACKGROUND OF THE INVENTION

FIG. 1 is a schematic block diagram showing the configuration of a hydraulic system to which a method of controlling a flow rate of a variable displacement hydraulic pump for a construction machine in accordance with an embodiment of the present invention is applied.

A conventional hydraulic system applied to a hydraulic construction machine such as an excavator includes:

a manipulation lever (RCV) 1 that outputs a manipulation signal that is in proportion to a manipulation amount of the manipulation lever by a user;

a variable displacement hydraulic pump (hereinafter, referred to as "hydraulic pump") 3 and a pilot pump 4 that are connected to an engine 2;

a hydraulic actuator (not shown) connected to the hydraulic pump 3;

a control valve 5 (for example, a spool for MCV is shown) that is installed in a discharge flow path of the hydraulic pump 3, and controls a start, a stop, and a direction change of the hydraulic actuator when it is shifted in response to the manipulation signal outputted from the manipulation lever 1;

a pilot pressure detection sensor 6 that detects a pilot signal pressure according to the manipulation of the manipulation lever 1;

a discharge pressure detection sensor 7 that detects a pressure of a hydraulic fluid discharged from the hydraulic pump 3; and a controller 8 that controls a discharge flow rate of the hydraulic pump 3 in response to detection signals outputted from the pilot pressure detection sensor 6 and the discharge pressure detection sensor 7.

In the drawings, a non-explained reference numeral 9 denotes an electro proportional pressure reducing valve that generates a secondary signal pressure in proportion to a control signal applied thereto from the controller 8 to control a swivel angle of a swash plate of the hydraulic pump 3

FIG. 2 is a flow chart showing a method of controlling a flow rate of a hydraulic pump in accordance with the prior art.

In a first step S100, when a user manipulates the manipulation lever 1, a manipulation signal corresponding to a manipulation amount of the manipulation lever 1 is detected by the pilot pressure detection sensor 6, which in turn generates a manipulation amount detection_signal for application to the controller 8. Thus, the discharge flow rate Q1 required by the hydraulic pump 3 in proportion to the manipulation amount of the manipulation lever 1 is calculated by using a relationship between the manipulation amount of the manipulation lever 1 and the volume of the hydraulic pump 3.

In a second step S200, a discharge pressure of the hydraulic pump 3 is detected by the discharge pressure detection sensor 7, which in turn generates a discharge pressure detection signal corresponding to the discharge pressure for application to the controller 8. Thus, a maximum dischargeable flow rate $Q_{max}$ within a range that does not exceed a specific horsepower or torque of the hydraulic pump 3, relative to the detected discharge pressure is calculated by a calculation equation.

In a third step S300, the discharge flow rate Q1 required by the hydraulic pump 3 in proportion to the manipulation amount of the manipulation lever 1 is compared with the maximum dischargeable flow rate $Q_{max}$ within the range that does not exceed the preset value.

If it is determined in the third step S300 that the discharge flow rate Q1 required by the hydraulic pump 3 is less than the calculated maximum dischargeable flow rate $Q_{max}$, the program proceeds to a fourth step S400 where the discharge flow rate of the hydraulic pump 3 is controlled in proportion to the manipulation amount of the manipulation lever 1.

On the contrary, if it is determined in the third step S300 that the discharge flow rate Q1 required by the hydraulic pump 3 exceeds the calculated maximum dischargeable flow rate $Q_{max}$, the program proceeds to a fifth step S500 where the discharge flow rate of the hydraulic pump 3 is controlled to be the maximum dischargeable flow rate $Q_{max}$ within the range that does not exceed the preset value.

The method of controlling the discharge flow rate of the hydraulic pump 3 as described above has the following advantages.

First, the discharge flow rate of the hydraulic pump 3 is increased in proportion to the manipulation amount of the manipulation lever 1 by the user, and the discharge flow rate of the hydraulic pump 3 is minimized in case of no manipulation of the manipulation lever 1, thereby reducing a loss or waste of hydraulic energy.

Second, in the case where the discharge pressure of the hydraulic pump 3 exceeds a preset value determined within a range that does not exceed a torque or horsepower allocated to the hydraulic pump 3, a flow rate as much as a pressure level that exceeds the preset value is limited (shown in FIG. 6), thereby reducing the flow rate determined in the first step.

In the case where the discharge pressure of the hydraulic pump 3 is controlled by the above-mentioned method, i.e., the discharge pressure of the hydraulic pump 3 is controlled by a mechanical mechanism or an electronic control device to limit the torque or horsepower, if the discharge pressure of the hydraulic pump 3 is high, there occurs a problem in that the control range of the manipulation lever 1 by the user is shortened. Particularly, even in the case where a more precise work is required such as the lifting work of heavy materials, the control range of the manipulation lever 1 is shortened, which makes it difficult to ensure a more precise manipulability.

FIG. 3 is a graph showing a correlation between the discharge pressure and the volume or flow rate of the hydraulic pump when the torque or horsepower of the hydraulic pump is limited. FIGS. 4 and 5 are graphs showing the control method of the flow rate of a hydraulic pump in accordance with the prior art, i.e., graphs showing a correlation between the manipulation amount of the manipulation lever and the discharge volume or flow rate of the hydraulic pump in points where the discharge pressures of the hydraulic pump are P1 and P2.

As shown in FIG. 4, the discharge flow rate of the hydraulic pump is increased in proportion to the manipulation amount of the manipulation lever within a range of the allowable discharge flow rate at a point where the discharge pressures of the hydraulic pump is P1.

In the meantime, as shown in FIG. 5, the discharge flow rate of the hydraulic pump is not increase any more in a range beyond a control range (b) even in the case where the manipulation amount of the manipulation lever is increased, at a point where the discharge pressures of the hydraulic pump is P2. Thus, there occurs a problem in that the control range (b) of the manipulation lever is relatively short as compared to a control range (a) of the manipulation lever as shown in FIG. 4, leading to a deterioration of manipulability.

As shown in FIG. 6, in the case where the manipulation amount of the manipulation lever is 50% or 75% of the maximum manipulation amount, if the discharge flow rate of the hydraulic pump exceeds the preset value determined to limit the torque or horsepower of the hydraulic pump, a flow rate corresponding to the excess portion is limited by a control diagram. As such, the control range in the case where the manipulation amount of the manipulation lever is 75% of maximum manipulation amount is shorter than that in the case where the manipulation amount of the manipulation lever is 50% of maximum manipulation amount, which makes it impossible to precisely manipulate the manipulation lever during the lifting work of heavy materials.

DETAILED DESCRIPTION OF THE INVENTION

Technical Problems

Accordingly, the present invention was made to solve the aforementioned problem occurring in the prior art, and it is an object of the present invention to provide a method of controlling a flow rate of a variable displacement hydraulic pump for a construction machine, in which in a state in which a preset value is determined which limits the maximum dischargeable flow rate of the hydraulic pump, the discharge flow rate of the hydraulic pump is controlled in proportion to the manipulation amount of the manipulation lever within a range that does not exceed the preset value so that a control range of the manipulation lever can be secured even in the case where a high load occurs during the work, thereby improving manipulability and safety.

Technical Solution

To accomplish the above object, in accordance with an embodiment of the present invention, there is provided a method of controlling a flow rate of a variable displacement hydraulic pump for a construction machine, which includes: a variable displacement hydraulic pump, a hydraulic actuator connected to the hydraulic pump, a manipulation lever configured to output a manipulation signal that is in proportion to a manipulation amount of the manipulation lever by a user, a control valve configured to control a start, a stop, and a direction change of the hydraulic actuator when it is shifted in response to the manipulation signal outputted from the manipulation lever, a manipulation amount detection means configured to detect the manipulation amount of the manipulation lever, a discharge pressure detection sensor configured to detect a pressure of a hydraulic fluid discharged from the hydraulic pump, and a controller configured to control a discharge flow rate of the hydraulic pump in response to detection signals outputted from the manipulation amount detection means and the discharge pressure detection sensor, the method including:

a first step of calculating a discharge flow rate of the hydraulic fluid, which is required by the hydraulic pump according to the manipulation amount of the manipulation lever by a user;

a second step of calculating an allowable discharge flow rate within a range that does not exceed a preset specific horsepower or torque of the hydraulic pump, relative to the discharge pressure of the hydraulic fluid detected by the discharge pressure detection sensor; and a third step of controlling a discharge flow rate of the hydraulic pump in proportion to the manipulation amount of the manipulation lever within a range of the allowable discharge flow rate value calculated in the second step.

According to a more preferable embodiment, in the third step, if the manipulation amount of the manipulation lever requires a maximum pump flow rate under a no-load condition, the discharge flow rate of the hydraulic pump is controlled to be a maximum dischargeable flow rate of the hydraulic pump, relative to a preset discharge pressure.

The discharge flow rate of the hydraulic pump is calculated by calculating the discharge flow rate required by the hydraulic pump according to the manipulation amount of the manipulation lever as a percentage under the no-load condition and multiplying the allowable discharge flow rate of the hydraulic pump relative to the preset discharge pressure by the calculated percentage.

Advantageous Effect

The method of controlling a flow rate of a variable displacement hydraulic pump for a construction machine in accordance with an embodiment of the present invention as constructed above has the following advantages.

In a state in which a preset value is determined which limits the maximum dischargeable flow rate of the hydraulic pump, the discharge flow rate of the hydraulic pump is controlled in proportion to the manipulation amount of the manipulation lever within a range that does not exceed the preset value so that a control range of the manipulation lever can be secured to improve manipulability and safety even during the lifting work of heavy materials. Further, in the case where a high load occurs during the work, a hydraulic fluid is discharged in at a state in which the open area of the spool (i.e., a spool for MCV) is widened, thereby reducing a pressure loss and thus improving a fuel efficiency.

BRIEF DESCRIPTION OF THE INVENTION

The above objects, other features and advantages of the present invention will become more apparent by describing the preferred embodiments thereof with reference to the accompanying drawings, in which.

Figure 1:
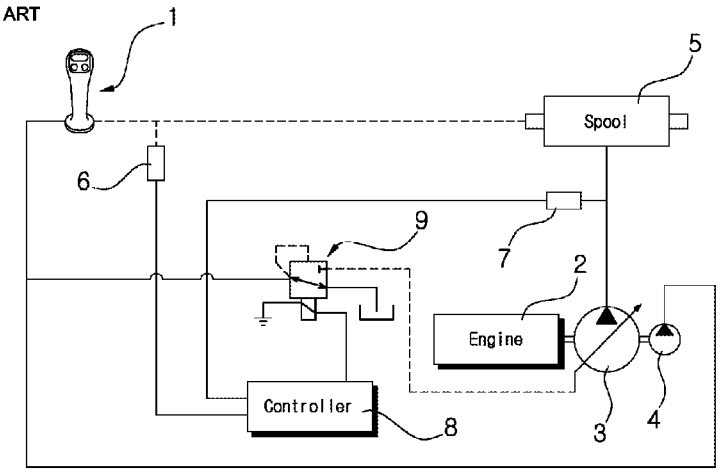
Fig. 1 PRIOR ART
FIG. 1 is a schematic block diagram showing the configuration of a hydraulic system to which a method of controlling a flow rate of a variable displacement hydraulic pump for a construction machine in accordance with an embodiment of the present invention is applied.
Figure 2:
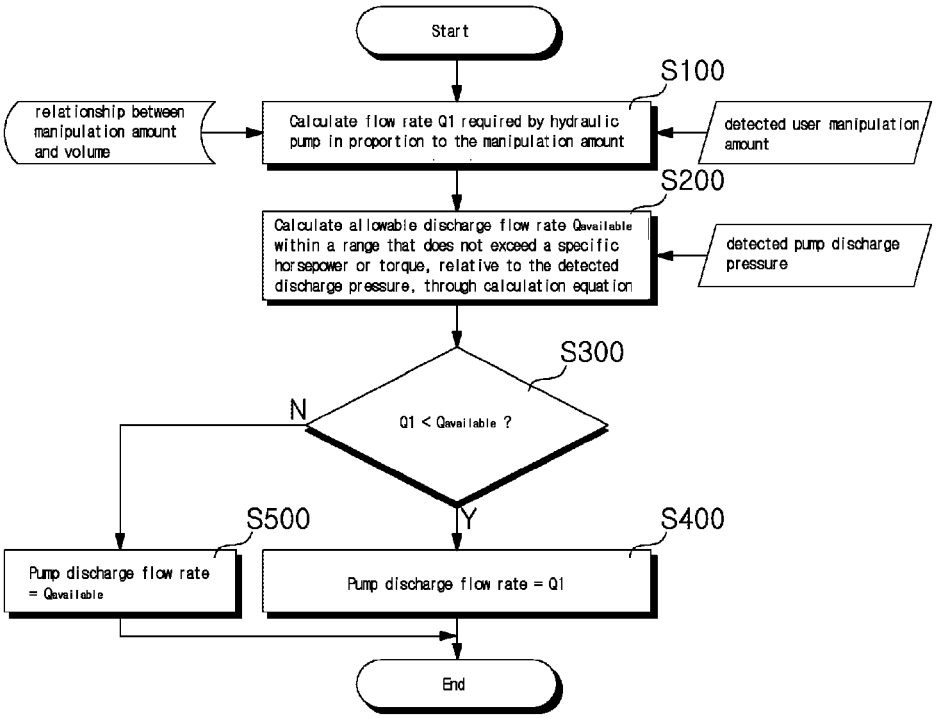
Fig. 2 PRIOR ART
FIG. 2 is a flow chart showing a method of controlling a flow rate of a hydraulic pump in accordance with the prior art.

*Explanation on reference numerals of main elements in the drawings*

| | |
|---|---|
| 1: manipulation lever (RCV) | 2: engine |
| 3: variable displacement hydraulic pump | 4: pilot pump |
| 5: control valve (MCV) | 6: pilot pressure detection sensor |
| 7: discharge pressure detection sensor | 8: controller |
| 9: electro proportional pressure reducing valve | |

PREFERRED EMBODIMENTS OF THE INVENTION

Now, preferred embodiments of the present invention will be described in detail with reference to the accompanying drawings. The matters defined in the description, such as the detailed construction and elements, are nothing but specific details provided to assist those of ordinary skill in the art in a comprehensive understanding of the invention, and the present invention is not limited to the embodiments disclosed hereinafter.

Figure 7:
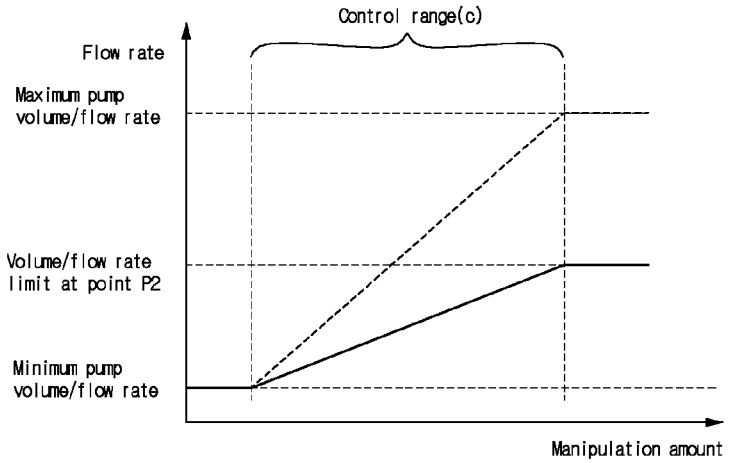
FIGS. 7 and 8 are graphs for explaining the control of the flow rate of a hydraulic pump in accordance with an embodiment of the present invention.
Figure 8:
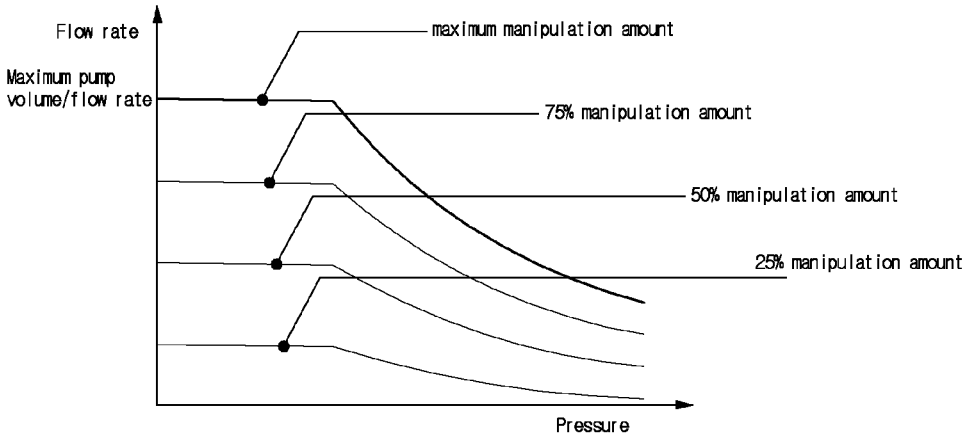
Figure 9:
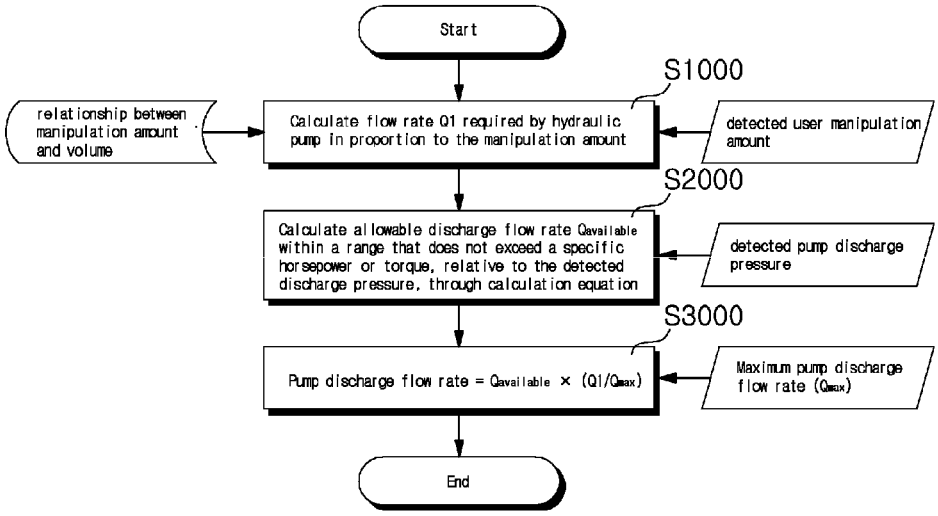
FIG. 9 is a flow chart showing a method of controlling a flow rate of a variable displacement hydraulic pump for a construction machine in accordance with an embodiment of the present invention.

As shown in FIGS. 7 to 9, in a method of controlling a flow rate of a variable displacement hydraulic pump 3 for a construction machine in accordance with an embodiment of the present invention, the construction machine includes:

a manipulation lever (RCV) 1 that outputs a manipulation signal that is in proportion to a manipulation amount of the manipulation lever by a user;

a variable displacement hydraulic pump (hereinafter, referred to as "hydraulic pump") 3 and a pilot pump 4 that are connected to an engine 2;

a hydraulic actuator (not shown) connected to the hydraulic pump 3;

a control valve 5 (for example, a spool for MCV is used) that controls a start, a stop, and a direction change of the hydraulic actuator (referring to a hydraulic cylinder) when it is shifted in response to the manipulation signal outputted from the manipulation lever 1;

a manipulation amount detection means 6 (for example, a pilot pressure detection sensor is used) that detects the manipulation amount of the manipulation lever 1;

a discharge pressure detection sensor 7 that detects a pressure of a hydraulic fluid discharged from the hydraulic pump 3; and a controller 8 that controls a discharge flow rate of the hydraulic pump 3 in response to detection signals outputted from the manipulation amount detection means 6 and the discharge pressure detection sensor 7.

The method of controlling the flow rate of the variable displacement hydraulic pump 3 for the construction machine includes:

a first step S1000 of calculating a discharge flow rate Q1 of the hydraulic fluid, which is required by the hydraulic pump 3 according to the manipulation amount of the manipulation lever 1 by a user;

a second step S2000 of calculating an allowable discharge flow rate $Q_{available}$ within a range that does not exceed a preset specific horsepower or torque of the hydraulic pump 3, relative to the discharge pressure of the hydraulic fluid detected by the discharge pressure detection sensor 7; and a third step S3000 of controlling a discharge flow rate Q of the hydraulic pump 3 in proportion to the manipulation amount of the manipulation lever 1 within a range of the allowable discharge flow rate value $Q_{available}$ calculated in the second step S2000.

In this case, in the third step S3000, if the manipulation amount of the manipulation lever 1 requires a maximum pump flow rate under a no-load condition, the discharge flow rate of the hydraulic pump 3 is controlled to be a maximum dischargeable flow rate Qmax of the hydraulic pump 3 relative to a preset discharge pressure.

Meanwhile, the discharge flow rate Q of the hydraulic pump 3 is calculated by calculating the discharge flow rate Q1 required by the hydraulic pump 3 according to the manipulation amount of the manipulation lever 1 as a percentage $Q1/Q_{max}$ under the no-load condition and multiplying the allowable discharge flow rate Qavailable of the hydraulic pump 3 relative to the preset discharge pressure by the calculated percentage $Q1/Q_{max}$.

Hereinafter, a use example of the method of controlling a flow rate of a variable displacement hydraulic pump for a construction machine in accordance with the present invention will be described in detail with reference to the companying drawings.

As shown in FIG. 9, in the first step S1000, in order to control the discharge flow rate of the hydraulic pump 3 as described above, when a user manipulates the manipulation lever 1, a manipulation signal outputted from the manipulation lever 1 is detected by the pilot pressure detection sensor 6, which in turn generates a manipulation amount detection signal for application to the controller 8. Thus, the discharge flow rate Q1 required by the hydraulic pump 3 according to the manipulation amount of the manipulation lever 1 is calculated by using a relationship between the manipulation amount of the manipulation lever 1 and the volume of the hydraulic pump 3

In the second step S2000, the discharge pressure of the hydraulic pump 3 is detected by the discharge pressure detection sensor 7, which in turn generates a discharge pressure detection signal for application to the controller 8. Thus, an allowable discharge flow rate value $Q_{available}$ is calculated by a calculation equation within a range that does not exceed a preset specific horsepower or torque of the hydraulic pump 3, relative to the discharge pressure of the hydraulic fluid detected by the discharge pressure detection sensor 7.

In the third step S3000, a discharge flow rate Q of the hydraulic pump 3 is controlled in proportion to the manipulation amount of the manipulation lever 1 within a range of the allowable discharge flow rate value $Q_{available}$ calculated in the second step S2000. In this case, if the manipulation amount of the manipulation lever 1 is a maximum amount, the discharge flow rate Q of the hydraulic pump 3 is controlled to be a maximum dischargeable flow rate Qmax of the hydraulic pump 3 relative to a preset discharge pressure.

In the meantime, the discharge flow rate Q of the hydraulic pump 3 is calculated by calculating the discharge flow rate Q1 required by the hydraulic pump 3 according to the manipulation amount of the manipulation lever 1 as a percentage $Q1/Q_{max}$ under the no-load condition and multiplying the allowable discharge flow rate Qavailable of the hydraulic pump 3 relative to the preset discharge pressure by the calculated percentage $Q1/Q_{max}$. That is, the discharge flow rate Q of the hydraulic pump 3 is calculated by the following equation:

$$Q=Q_{available}\times(Q1/Q_{max}).$$

As such, in a state in which a preset value is determined which limits the maximum dischargeable flow rate of the hydraulic pump 3 that is set within a range that does not exceed a preset specific horsepower or torque of the hydraulic pump 3, relative to the preset discharge pressure, the discharge flow rate of the hydraulic pump 3 can be controlled in proportion to the manipulation amount of the manipulation lever 1 within a range that does not exceed the preset value.

In other words, as shown in FIG. 8, from a curve representing a preset maximum dischargeable flow rate range value of the hydraulic pump, and curves representing 75%, 50% and 25% of the maximum manipulation amount, it can be found that the discharge flow rate of the hydraulic pump is controlled in proportion to the manipulation amount of the manipulation lever within the preset maximum dischargeable flow rate range value of the hydraulic pump.

Figure 3:
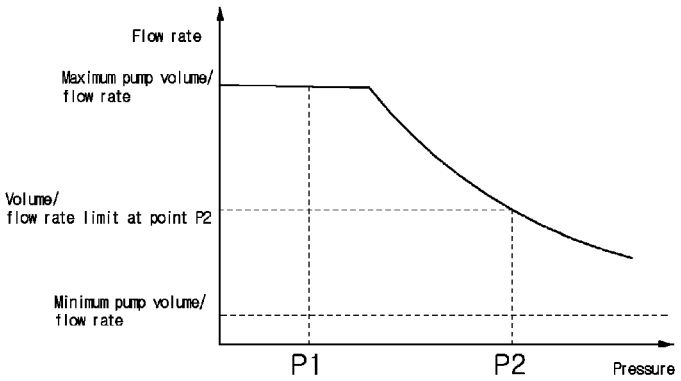
Fig. 3 PRIOR ART
FIGS. 3 to 6 are graphs for explaining the control of the flow rate of a hydraulic pump in accordance with the prior art.
Figure 4:
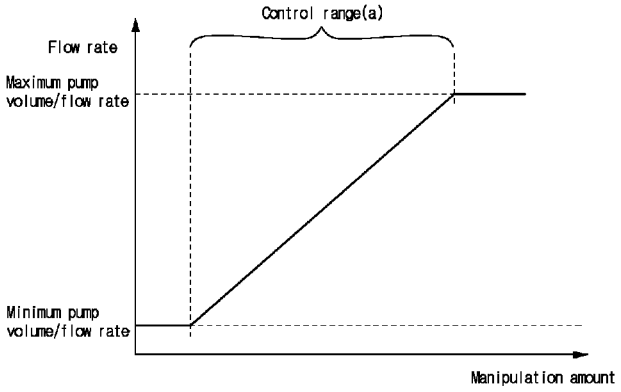
Fig. 4 PRIOR ART
Figure 5:
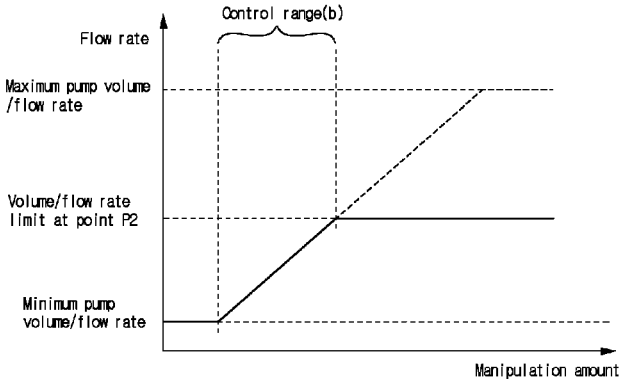
Fig. 5 PRIOR ART
Figure 6:
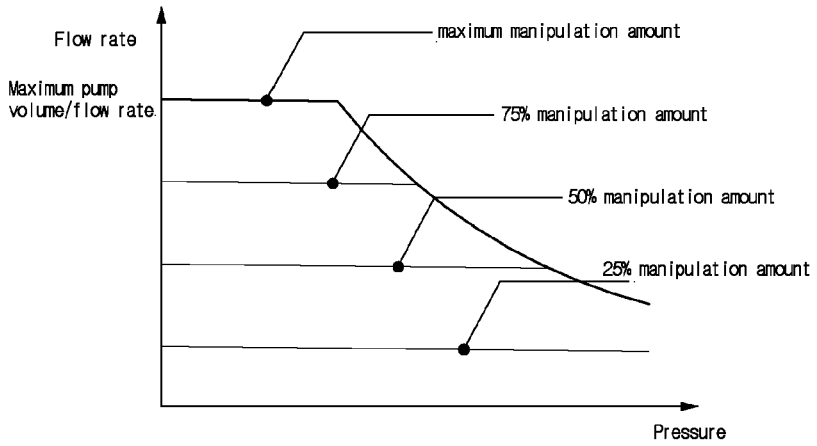
Fig. 6 PRIOR ART

As shown in FIG. 7, it can be found that the discharge flow rate of the hydraulic pump is increased in proportion to the manipulation amount of the manipulation lever within a range of the maximum dischargeable flow rate at a point where a discharge pressure of the hydraulic pump is P1 as shown in FIG. 3 (shown in a dotted line in FIG. 7). On the other hand, it can be found from FIG. 7 that a control range (c) of the manipulation lever is relatively long as compared to a control range (b) of the manipulation lever according to the prior art shown in FIG. 5 at a point where a discharge pressure of the hydraulic pump is P2 as shown in FIG. 3 (shown in a solid line in FIG. 7).

As a result, a control range is extended even in a work region in which a high load occurs. In particular, more precise manipulability and safety are ensured during the lifting work of heavy materials. In addition, in the case where a load occurs during the work, a hydraulic fluid is discharged in a state in which the open area of the spool is widened, thereby reducing a pressure loss and thus improving a fuel efficiency.

INDUSTRIAL APPLICABILITY

As described above, according to the method of controlling a flow rate of a variable displacement hydraulic pump for a construction machine in accordance with an embodiment of the present invention, in a state in which a preset value is determined which limits the maximum dischargeable flow rate of the hydraulic pump, the discharge flow rate of the hydraulic pump is controlled in proportion to the manipulation amount of the manipulation lever within a range that does not exceed the preset value so that a control range can be secured to improve manipulability even during the lifting work of heavy materials. Further, in the case where a high load occurs during the work, a hydraulic fluid is discharged in at a state in which the open area of the spool is widened, so that a pressure loss can be reduced.

The invention claimed is:

1. A method of controlling a flow rate of a variable displacement hydraulic pump for a construction machine which comprises: a variable displacement hydraulic pump, a hydraulic actuator connected to the hydraulic pump, a manipulation lever configured to output a manipulation signal that is in proportion to a manipulation amount of the manipulation lever by a user, a control valve configured to control a start, a stop, and a direction change of the hydraulic actuator when it is shifted in response to the manipulation signal outputted from the manipulation lever, a manipulation amount detector configured to detect the manipulation amount of the manipulation lever and electrically connected to a controller, a discharge pressure detection sensor configured to detect a pressure of a hydraulic fluid discharged from the hydraulic pump, and a controller configured to control a discharge flow rate of the hydraulic pump in response to detection signals outputted from the manipulation amount detection detector and the discharge pressure detection sensor, the method comprising:

a first step of calculating a discharge flow rate of the hydraulic fluid, which is required by the hydraulic pump according to the manipulation amount of the manipulation lever by a user;

a second step of calculating an allowable discharge flow rate within a range that does not exceed a preset specific horsepower or torque of the hydraulic pump, relative to the discharge pressure of the hydraulic fluid detected by the discharge pressure detection sensor; and a third step of controlling a discharge flow rate of the hydraulic pump in proportion to the manipulation amount of the manipulation lever within a range of the allowable discharge flow rate value calculated in the second step;

wherein the discharge flow rate of the hydraulic pump is calculated by calculating the discharge flow rate required by the hydraulic pump according to the manipulation amount of the manipulation lever as a percentage under the no-load condition and multiplying the allowable discharge flow rate of the hydraulic pump relative to the preset discharge pressure by the calculated percentage.

2. The method according to claim 1, wherein in the third step, if the manipulation amount of the manipulation lever requires a maximum pump flow rate under a no-load condition, the discharge flow rate of the hydraulic pump is controlled to be a maximum dischargeable flow rate of the hydraulic pump relative to a preset discharge pressure.

3. A method for controlling a flow rate of a variable displacement hydraulic pump for actuating a boom arm of an excavator comprising;

detecting with a pilot pressure detection sensor a manipulation signal output from a manipulation lever moved by a user to move the boom arm;

generating with the pilot pressure detection sensor a manipulation amount detection signal for application to a controller configured to control the variable displacement hydraulic pump;

calculating with the controller a discharge flow rate (Q1) required by the variable displacement hydraulic pump according to a manipulation amount that the user moves the manipulation lever based on a relationship between the manipulation amount of the manipulation lever and a volume of the hydraulic pump;

detecting discharge pressure of the hydraulic pump with a discharge pressure detection sensor, which generates a discharge pressure detection signal that is sent to the controller;

calculating an allowable discharge flow rate ($Q_{allowable}$) of the hydraulic pump within a range that does not exceed a preset specific horsepower or torque of the hydraulic pump, relative to the discharge pressure of hydraulic fluid detected by the discharge pressure detection sensor; and controlling a discharge flow rate (Q) of the hydraulic pump in proportion to the manipulation amount of the manipulation lever within a range of the allowable discharge flow rate value ($Q_{allowable}$);

wherein:

if the manipulation amount of the manipulation lever is a maximum amount, the discharge flow rate Q of the hydraulic pump is controlled to be a maximum dischargeable flow rate Qmax of the hydraulic pump relative to a preset discharge pressure;

the discharge flow rate Q of the hydraulic pump is calculated by calculating the discharge flow rate Q1 required by the hydraulic pump according to the manipulation amount of the manipulation lever as a percentage (Q1/Qmax) under a no-load condition and multiplying the allowable discharge flow rate ($Q_{allowable}$) of the hydraulic pump relative to the pre-set discharge pressure by the calculated percentage Q1/Qmax; and the discharge flow rate Q of the hydraulic pump for actuating the boom arm of the excavator is calculated using the following equation: $Q=Q_{allowable}\times(Q1/Qmax)$.

* * * * *